US012459707B2

(12) United States Patent
Guerrero Gamaza et al.

(10) Patent No.: US 12,459,707 B2
(45) Date of Patent: Nov. 4, 2025

(54) CLOSURE FOR CONTAINERS WITH EVIDENCE OF FIRST OPENING

(71) Applicant: TORRENT INNOVA, S.L., Cádiz (ES)

(72) Inventors: Jorge Antonio Guerrero Gamaza, Cádiz (ES); Eduardo Jiménez Gálvez, Cádiz (ES)

(73) Assignee: TORRENT INNOVA, S.L., Cádiz (ES)

( * ) Notice: Subject to any disclaimer, the term of this patent is extended or adjusted under 35 U.S.C. 154(b) by 41 days.

(21) Appl. No.: 18/574,765

(22) PCT Filed: Jun. 27, 2022

(86) PCT No.: PCT/ES2022/070403

§ 371 (c)(1),
(2) Date: Dec. 28, 2023

(87) PCT Pub. No.: WO2023/275419

PCT Pub. Date: Jan. 5, 2023

(65) Prior Publication Data

US 2024/0317466 A1 Sep. 26, 2024

(30) Foreign Application Priority Data

Jun. 29, 2021 (EP) ..... 21382570

(51) Int. Cl.
*B65D 41/34* (2006.01)

(52) U.S. Cl.
CPC ..... *B65D 41/34* (2013.01); *B65D 2401/15* (2020.05)

(58) Field of Classification Search
CPC ..... B65D 41/34; B65D 2401/15; B65D 41/3447; B65D 41/62; B65D 51/18; B65D 55/022; B65D 85/72; B65D 49/04
See application file for complete search history.

(56) References Cited

U.S. PATENT DOCUMENTS 5,082,130 A * 1/1992 Weinstein ..... A61J 7/04 215/230
5,975,322 A 11/1999 Reid
7,344,042 B2 * 3/2008 Hagano ..... B60K 15/0406 220/300
8,141,550 B2 * 3/2012 Lawrence ..... G09F 11/04 128/200.14
2011/0259844 A1 10/2011 Skelton et al.

FOREIGN PATENT DOCUMENTS

EP 1925561 A1 5/2008

* cited by examiner

*Primary Examiner* — James N Smalley
(74) *Attorney, Agent, or Firm* — S.J. Intellectual Property LTD.

(57) ABSTRACT

The present invention relates to a cap-type closure for containers comprising means for showing evidence of a first opening, the closure preferably being coupled to the mouth of a container. The present invention is characterized by a closure comprising an inner cap and an outer cap interconnected to one another so as to allow a spacing to be set between the two once the first opening of the closure takes place.

12 Claims, 10 Drawing Sheets

CLOSURE FOR CONTAINERS WITH EVIDENCE OF FIRST OPENING

OBJECT OF THE INVENTION

The present invention relates to a cap-type closure for containers comprising means for showing evidence of a first opening, the closure preferably being coupled to the mouth of a container, for example a bottle.

The present invention is characterized by a closure comprising an inner cap and an outer cap interconnected to one another so as to allow a spacing to be set between the two once the first opening of the closure takes place. This spacing generates a visual change in the appearance of the closure, with evidence of the first opening being shown.

To ensure the evidence of a first opening of the closure, the present invention combines, among others, a groove with a helical segment with a flange that moves through said groove until reaching a housing in which its movement is irreversibly blocked by means of a flexible prolongation. The movement of the flange in the groove defines the transition between a first position before the first opening and a second position after the first opening of the closure.

BACKGROUND OF THE INVENTION

Closures with means for preventing the fraudulent refilling or tampering of the content of bottles or containers are of enormous interest in the marketing of beverages having a high value, such as bottles intended for liquor, for example.

There are many means for showing evidence of a first use or opening of a closure for bottles such that the closure shows certain features before being opened for the first time and other features after being opened for the first time. Certain features that are modified in the first opening are those which show evidence that the closure has been opened for the first time.

The means for showing evidence of the first opening can be different in nature. For example, there are closures which use breakable bridges joining two parts together that are separated after the closure has been opened for the first time. One of these parts can be, for example, a ring which detaches, exposing part of the closure that was previously not visually accessible.

If the part that is exposed after the first opening is of a different color, the evidence of said first opening visually stands out in an even more noticeable way.

The changes a closure experiences for showing evidence of the first opening do not necessarily have to be visual, but rather can use the other senses. For example, the changes can be in term of sound. This is the case when there are elements fixed by means of a type of fastening which, after the first opening, though possibly still housed in a given cavity, for example, may present a certain allowance which causes the closure to make noise, or to make a different noise, when moved.

These known elements use guides in order to establish a separation between two components of the cap in a first axial movement. An advantage of the use of these guides is that they can be housed internally, which prevents them from being fraudulently tampered with from the outside. Once the end of the guided path has been reached, the irreversibility must be ensured for evidence of the first opening to be shown, such that the configuration before and after the first opening is different.

The mechanisms used for irreversibility include, among others, path changes in the guides leading to positions perpendicular to the path which allows the helical movement, and the combination of teeth oriented in one direction and catches which are actuated when advancing in one direction but blocked when attempting to advance in the opposite direction.

In the first solution, when the flanges advancing along the guide reach the perpendicular direction change, they are housed in a space which prevents the flange from advancing in both directions. Nevertheless, the movement that this housing allows gives rise to an axial movement which is not continuous and can be reverted by seeking out the inverse movement.

The second solution gives rise to configurations that are complex in terms of execution and less reliable given that the anchoring of the teeth is not always suitable, and the configuration of the catch is not resistant enough.

The present invention relates to a closure element which allows the aforementioned problem to be resolved by means of a specific configuration and combination of components ensuring evidence of the first opening, the internal mechanisms are not accessible from the outside to prevent tampering, and resistance to forcing is very high.

DESCRIPTION OF THE INVENTION

The invention solves the problems identified above with a closure for containers with evidence of first opening according to claim 1. The dependent claims define specific embodiments of this closure.

A first inventive aspect of the invention defines a closure for containers with evidence of first opening configured so as to be coupled to the mouth of a container according to an axial direction X-X'.

The axial direction X-X' is the main longitudinal direction of the mouth of the container and also the main direction that the closure or cap itself follows when coupled on the mouth of the container.

Positional and orientation terms such as upper, lower, deep area, etc., will be used. These positional terms must be interpreted with respect to the orientation adopted by a container with its mouth located in the upper part, where the closure is placed.

The present closure comprises:

- an inner cap comprising:
  - a main body;
  - an inner thread complementary to a thread of either the mouth of the container or of a pouring element;
  - fixing means adapted for being fixed to the container;
  - breakable means adapted for connecting the main body and the fixing means, wherein these breakable means are adapted for breaking when a pre-established torque between the main body and the fixing means is surpassed in the operating mode;
- an outer cap configured for at least partially housing the main body of the inner cap;

Following the axial direction X-X', the invention proposes for the closure an inner cap formed by a main body, an inner thread complementary to a thread of the mouth of the container or of a pouring element, fixing means which allow being fixed to the container, and breakable means connecting the main body with the fixing means; and an outer cap which is exposed to the outside and at least partially houses therein the main body of the inner cap.

The inner thread of the inner cap is arranged on the inside of the main body and is configured so as to be complementary with a thread of the mouth of the container or of a pouring element. That is, the inner cap is configured for being threadably coupled on the mouth of a container or pouring element by means of said inner thread.

The inner cap comprises fixing means arranged at a lower end of this inner cap such that the main body of the inner cap is initially fixed to the container. These fixing means allow the closure as a whole to be fixed through the inner cap to the container. In turn, the inner cap comprises breakable means connecting the main body with the fixing means, and when a pre-established torque applied between the main body and the fixing means is surpassed in the operating mode, these breakable means break.

The breaking of the breakable means is an indication of a first use or first opening of the container. The breaking of the breakable means generates a sound which itself is a form of evidence of first opening in addition to those that will be described below. Furthermore, once the breakable means are broken by surpassing said pre-established torque between the main body and the fixing means, the closure allows the screwing on and off around the mouth of the container or pouring element by means of the mentioned inner thread of the inner cap. Therefore, between the main body coupled to the mouth of the container or pouring element and the fixing means fixed to the container, there are interposed breakable means establishing a temporary attachment which will be relevant in the opening process that will be described below.

The fixing means can define a direct fixing between the inner cap and the container or can define a fixing of the inner cap to the container by means of other intermediate components.

Moreover, the invention proposes an outer cap at least partially covering the main body of the inner cap and protecting it from the outside.

Both, i.e., the inner cap and outer cap, mainly have a cylindrical configuration extending along the axial direction X-X'. Cylindrical configuration is generally understood to mean any configuration the main side wall of which is the result of the rotation of a generatrix around a directrix understood according to the axial direction X-X'. Preferably, this generatrix is a straight line parallel to the axis of rotation coinciding with the axial direction X-X', at least the main structure of each respective cap giving rise to a cylinder having a constant circular section.

The present closure is characterized in that a first part, either the inner cap or the outer cap, comprises a flange directed towards a second part other than the first part, either the outer cap or the inner cap. That is, the closure is made up of a first and second part, where each of them may be either the inner cap or the outer cap, respectively.

The second part comprises:

- at least one groove with a helical segment according to the axial direction X-X' configured for guiding the path of the flange of the first part such that a relative rotation between the first part and the second part brings about a mutual axial movement X-X;
- a housing for the flange;
- an elastically deformable prolongation configured for restricting the section of the groove in at least one part of the helical segment, with a section smaller than what is required for the passage of the flange such that, in the operating mode, the forced passage of the flange causes the elastically deformable prolongation to bend;
- and wherein the configuration of the groove is such that, after the flange reaches the housing, the flexible prolongation elastically recovers its initial position, partially or completely, irreversibly blocking the flange from coming out of the housing.

The groove arranged in the second part guides the flange of the first part when both first and second parts rotate relative to one another, with this relative rotation causing the movement of both first and second parts according to the axial direction X-X'. In particular, the groove has a helical segment according to the axial direction X-X'. In the context of the invention, the helical configuration of the groove will be understood as a configuration in which the path of the groove establishes a guiding for the flange causing a relative movement between the first part and the second part consisting of a rotation plus an axial movement. Given that the preferred configuration of the groove is on the cylindrical side surface of the first body or of the second body, the groove is helically shaped with a rotation and advancement according to the axial direction X-X'.

The groove comprises a housing configured for receiving the flange of the first part wherein the housing is preferably located at one end of the groove. The section of the groove in question is restricted by means of an elastically deformable prolongation in at least one part of the helical segment of the groove itself. This restriction in the section of the groove provides a smaller section that what is needed to allow the passage of the flange through the groove. In the operating mode, when the flange is forced to pass through the groove in the reduced section, it brings about the bending of the elastically deformable prolongation. Once the flange reaches the housing after having travelled along the helical segment of the groove as a result of the relative rotation between the first part and the second part, the elastically deformable prolongation elastically recovers its initial position irreversibly blocking the flange from being able to come out of the housing and therefore blocking the first part and the second part from returning to the original position before the first opening.

In particular, the torque required for the forced passage of the flange through the groove causing the elastically deformable prolongation to bend is less than the torque required for breaking the breakable means. This difference in torque means that the breakable means do not break in the initial step of opening. The passage of the flange through the reduced section forcing the elastically deformable prolongation to bend requires a stress that the breakable means must withstand without breaking, ensuring that the part fixed to the container does not move. Once the flange has reached its housing it releases the flexible prolongation so that it recovers its position. Preferably, the position of the housing is located at the final part of the end of the groove such that the flange reaches the final end of the groove. The user continues to apply torque, but since the flange can no longer advance further, the value of the torque exceeds the resistant capacity of the breakable means and said means give way, with the connection between the fixing means for fixing to the container and the cap disappearing. Nevertheless, at this point the flange has already reached an irreversible position, and the irreversibility of the process is therefore ensured.

The first part and the second part comprise two end positions.

A first position before the first opening in which the flange is located in the groove in a position away from the housing. In the operating mode, this position corresponds to the state prior to exerting the torque bringing about the forced passage of the flange through the groove towards the housing. Therefore, the flange is located in the groove in a position away from the mentioned housing such that there is still no spacing between the first part and the second part. This position is the position that the flange has when assembling the cap and therefore before the first opening.

A second position after the first opening in which the flange is located in the housing after surpassing the groove segment restricted by the elastically deformable prolongation such that the first part and the second part are axially spaced with respect to the first position resulting in the irreversible separation between the first part and the second part, showing evidence of the first opening, and wherein said spacing is visually accessible.

The second position is established once the first opening of the closure takes place, i.e., when the torque needed for the flange to be located in the housing after having surpassed the retention imposed by the elastically deformable prolongation in the groove has already been applied. Right after reaching this second position is when the subsequent breaking of the breakable means takes place. The forced passage of the flange in the groove towards the housing causes the elastically deformable prolongation to bend, allowing the passage of the flange, and it is because of its elastically deformable configuration that this prolongation resumes its retention position (initial or rest position) once said flange surpasses this retention running through the groove until reaching the housing arranged at one end of the groove. The fact that the prolongation recovers its deformation-free state ensures that the flange is arranged in the housing and thus prevents same from moving back through the groove since it restrains its movement, being limited by the presence of the prolongation preventing it from going back.

When the flange reaches the housing and is positioned therein, the first part and the second part are axially spaced in comparison with the first position, which results in an irreversible axial separation between the first and second parts. Furthermore, this separation between the first and second parts occurring in the second position provides evidence of the first opening of the present closure such that this spacing between the first part and the second is visible from outside the closure. Preferably, the spacing between both parts provides visual access to an annular segment that was not visible before.

Accordingly, by means of transitioning from the first position to the second position as explained, movement between the first and second parts which is visually accessible and shows evidence of a first opening of the closure is achieved. Advantageously, as a result of this visible evidence of the spacing between the first and second parts, it is possible to know by simply viewing the closure that it has been previously opened. According to one embodiment, the color of the surface that is initially concealed and visually accessible after the first opening is different from the outer surfaces of the cap, showing further evidence of the first opening.

In turn, the fact that the first and second parts are irreversibly separated from one another with means that are not accessible from the outside prevents being able to tamper with the mechanisms ensuring the irreversibility, so keeping the closure with both parts in the second position is advantageously achieved, thus showing evidence of a first opening of the closure.

In a particular embodiment, the first part is the inner cap and the second part is the outer cap. That is, the groove configuration with a housing at one end and an elastically deformable prolongation is arranged in the outer cap while the flange is arranged in the inner cap. Applying a necessary torque on the outer cap to cause the first opening causes the closure to reach the second position in which the flange of the inner cap reaches the housing in the outer cap after surpassing the elastically deformable prolongation which the flange encounters in its movement in the groove.

The subsequent breaking of the breakable means allows the separation of the cap for the container to be opened.

The transition of the closure from the first position to the second position by positioning the flange in the housing causes the outer cap to be axially spaced from the inner cap and this spacing which shows evidence of a first opening of the closure is visually observed as a consequence. The torque needed to break the breakable means of the closure and for this closure to reach the mentioned second position is applied on the outer cap with respect to the inner cap.

When the container is closed again, the cap axially descends until abutting, for example, with the pouring element, ensuring the leak-tightness, but in no case is the spacing showing evidence of the first opening reduced again.

More particularly, the elastically deformable prolongation comprises a configuration complementary to at least one part of the flange adapted for being supported on the flange when it is located in the housing and such that it establishes a support retaining the bending of the elastically deformable prolongation. This particular configuration of the elastically deformable prolongation is supported on a part of the flange such that it retains said flange in the housing in the second position. In the deformation due to bending of the elastically deformable element, the end of this element produces a movement which may approximate an arc of curve. Being supported on the flange by means of a part with a complementary configuration ensures a coupling which generates a retention preventing the movement of the end of the elastically deformable prolongation in the path of the arc, whereby further ensuring the irreversibility of the second position. Additionally, the forcing from the second position to the first position gives rise to a compressive stress of the elastically deformable element. For a specific degree of slenderness of the prolongation, a failure due to buckling may occur, putting the stability of the second position at risk. The slenderness of the elastically deformable prolongation can be increased by reducing the torque needed to cause its deformation by bending, facilitating the opening for the user. The better support of the end by means of a portion having a configuration complementary with the flange increases the stability of the support and reduces the risk of buckling of the elastically deformable element.

In a particular embodiment, the assembly formed by the groove and the flange is concealed, preferably by a capsule covering the outer cap. Advantageously, this capsule protects the groove and flange assembly and keeps it concealed under said capsule, thus preventing tampering given that evidence of the attempt to destroy the cap or to access the mechanism would be shown.

In a particular embodiment, the closure further comprises a capsule comprising a lower skirt and an upper portion for covering the outer cap at least partially, wherein:

- the breakable means are configured by means of a ring with a perimetral flange;
- the lower skirt is notched in order to retain the perimetral flange of the breakable means in order to fix the breakable means either to a pouring element or to the container.

The breakable means comprise a ring with a perimetral flange which is retained in a pouring element or container by means of the notched edge of the lower skirt of the capsule which exerts a retaining force on said ring. The breakable means are located between the ring with a perimetral flange and the rest of the cap. The securing of the ring to the pouring element or container is advantageously achieved so that when sufficient torque is exerted on the closure, the breakable means break as a consequence of the rotation of the upper skirt of the capsule (and driving both the inner and outer caps with it). That is, the applied torque causes the upper skirt of the capsule together with the inner and outer caps to rotate with respect to the perimetral ring after the breakable means, which are fixed to the pouring element or container through a ring fixed by means of the lower skirt of said capsule, give way.

In a more particular embodiment, the spacing between the first part and the second part after the first opening leaves the ring of the breakable means visually accessible.

In other words, the evidence of a first opening of the present closure is provided by means of the perimetral ring of the breakable means being visible after the spacing between the first and second parts. Therefore, in the first position of the parts (outer cap and inner cap), both skirts of the capsule are in contact and located one after the other; however, in the second position a spacing is provided not only between the outer cap and the inner cap but also between the upper skirt of the capsule and the lower skirt. This is as a result of the first skirt, as mentioned above, partially covering the outer cap and the lower skirt covering a pouring element or the container securing the perimetral ring of the breakable means.

In a particular embodiment, the closure comprises a pouring element configured for being coupled to the container comprising:

an outer thread complementary to the inner thread of the inner cap;

a skirt adapted for being coupled to the container.

The pouring element comprises an outer thread on which the inner cap is screwed through its own inner thread, the inner cap (and accordingly the inner cap as well) is thereby fixed to the pouring element. With this configuration, the container does not need to have the thread configured. Furthermore, the pouring element comprises a skirt in its lower part, i.e., below its outer thread, through which it allows the pouring element to be coupled to a container or container mouth. Therefore, this pouring element allows the coupling of the present closure to a container or bottle so as to allow showing evidence of a first opening thereof, minimizing the possibility of tampering with said closure.

More particularly, the pouring element comprises a pouring surface and the inner cap comprises a complementary prolongation adapted for being supported on the pouring surface in order to establish the leak-tight closure between the two. Through the support or contact between the prolongation of the inner cap, which is complementary to a pouring surface of the pouring element itself, a leak-tight closure between the inner cap, in particular its main body, and the pouring element is advantageously established. The content of the container which flows through the pouring element is thereby prevented from passing into the inner cap. Given that the spacing between the inner cap and the outer cap generates a higher elevation of the outer cap, the interaction between the inner cap and the pouring element is not affected by the solution showing evidence of the first opening.

In a particular embodiment, the closure comprises a valve to prevent the fraudulent refilling of the container. As a result of this valve, tampering with the inside of the container or bottle on which the present closure is coupled, and accordingly the fraudulent refilling thereof, are prevented.

In a particular embodiment:

the inner cap comprises a first upper surface transverse to the axial axis X-X' showing at least one upper housing radially spaced from the center established by the axial axis of rotation X-X';

the outer cap comprises a second upper surface transverse to the axial axis X-X' showing at least one supporting flange radially spaced from the center established by the axial axis of rotation X-X' by the same distance as the upper housing of the first upper surface;

wherein:

in the first position between the first part and the second part the supporting flange is housed in the upper housing, and in the second position between the first part and the second part the supporting flange is in contact with the transverse first upper surface and outside of the upper housing.

The upper housing of the inner cap is understood as a groove arranged towards the inside of the inner cap itself. The supporting flange is understood as a projection protruding from the upper surface of the outer cap towards the inside of same, i.e., oriented towards the outer surface of the inner cap.

The joint configuration of the upper housing in the inner cap and the supporting flange in the outer cap allows ensuring the spacing between these parts, i.e., outer cap and inner cap, when transitioning from the first position to the second position. In other words, this configuration causes the closure to be robust and to ensure its purpose, which is to show evidence of a first opening of the closure without the option that it can be tampered with. One way to tamper with the mechanism for showing evidence of the first opening consists of applying an axial force that surpasses any retention mechanism which maintains the spacing between the outer cap and the inner cap. The supporting flanges are housed in the housings of the inner cap before the first opening and, after the first opening, with the relative rotation of the inner cap with respect to the outer cap, the flanges are located outside the housing and supported directly on the upper surface of the inner cap. This support absorbs axial forces without said forces being transmitted to the rest of the elements, ensuring the spacing showing evidence of the first opening.

In a more particular embodiment, the at least one upper housing of the inner cap comprises a depth which decreases from the upper surface of the inner cap to the deepest point of said upper housing, such that when transitioning from a first position to a second position, the at least one supporting flange of the outer cap moves along the upper housing from the deepest point of the upper housing until reaching the upper surface and being outside of the upper housing.

The upper housing arranged in the inner cap has a varying depth, decreasing from the upper surface of the inner cap towards the deepest point of this upper housing. The transition from the first position to the second position caused by a torque needed to bring about a spacing between the inner cap and the outer cap causes the supporting flange of the outer cap to slide or at least not to be hindered in its movement along the upper housing until being supported on the upper surface of the inner cap.

In a more particular embodiment, the closure is made up of a plurality of upper housings on the upper surface of the inner cap and a plurality of supporting flanges on the outer surface of the outer cap which are complementary with said housings. In the first position between the first part and the second part, the supporting flanges are housed in the upper housings, respectively. In the second position between the first part and the second part, the supporting flanges are in contact with the transverse first upper surface of the inner cap and outside of said upper housings.

According to another embodiment, there are two or more groups of flanges and housings located at a different radial distance. In particular, one or more flanges are located in a position where the diameter is maximum, leaving the housings open towards the side wall of the inner cap. When located in more distant positions according to the radial direction, the angular movement of the flange is also greater.

DESCRIPTION OF THE DRAWINGS

These and other features and advantages of the invention will become more apparent from the following detailed description of a preferred embodiment, given only by way of illustrating and non-limiting example, in reference to the attached figures.

DETAILED DESCRIPTION OF THE INVENTION

The present invention describes a closure device for containers with evidence of a first opening. This closure is configured so as to be coupled to the mouth of a container or bottle or pouring element according to an axial direction X-X'.

Figure 1B:
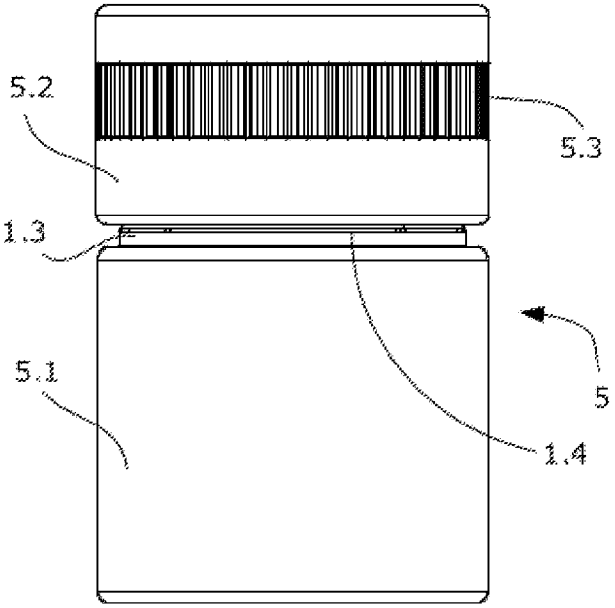
FIG. 1B shows an elevational view of the same closure as in FIG. 1A in a second position after the first opening thereof.
Figure 1A:
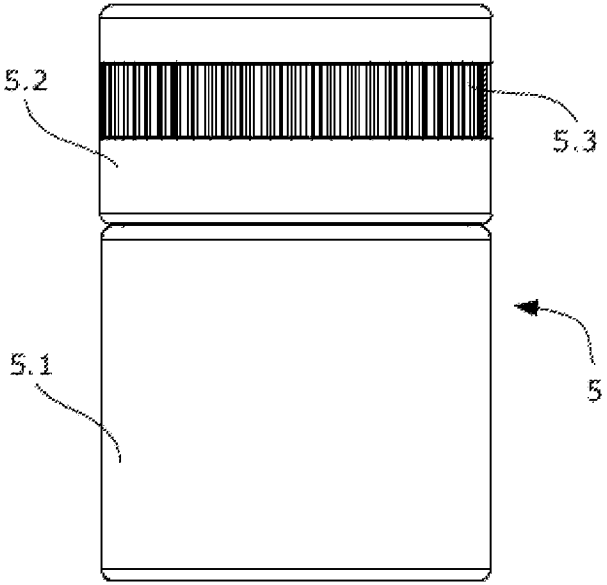
FIG. 1A shows an elevational view of a closure in a first position before the first opening thereof according to an embodiment of the present invention.
Figure 9:
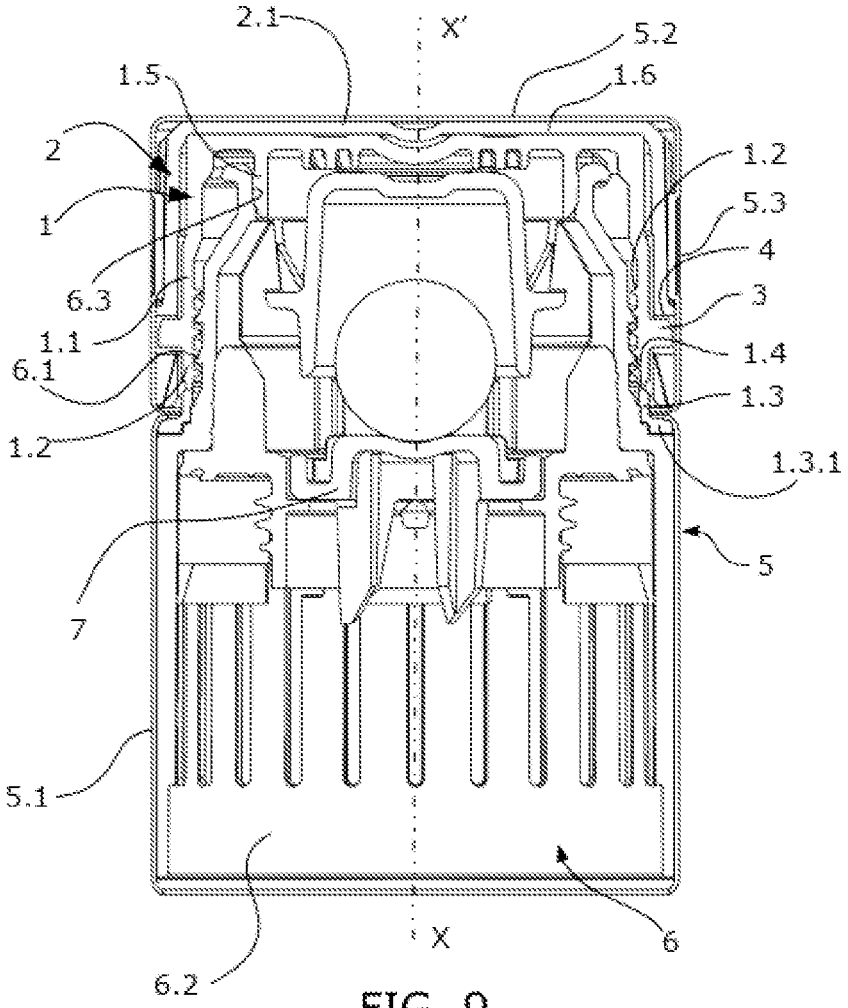
FIG. 9 shows a section view of the closure of FIG. 1A.
Figure 10:
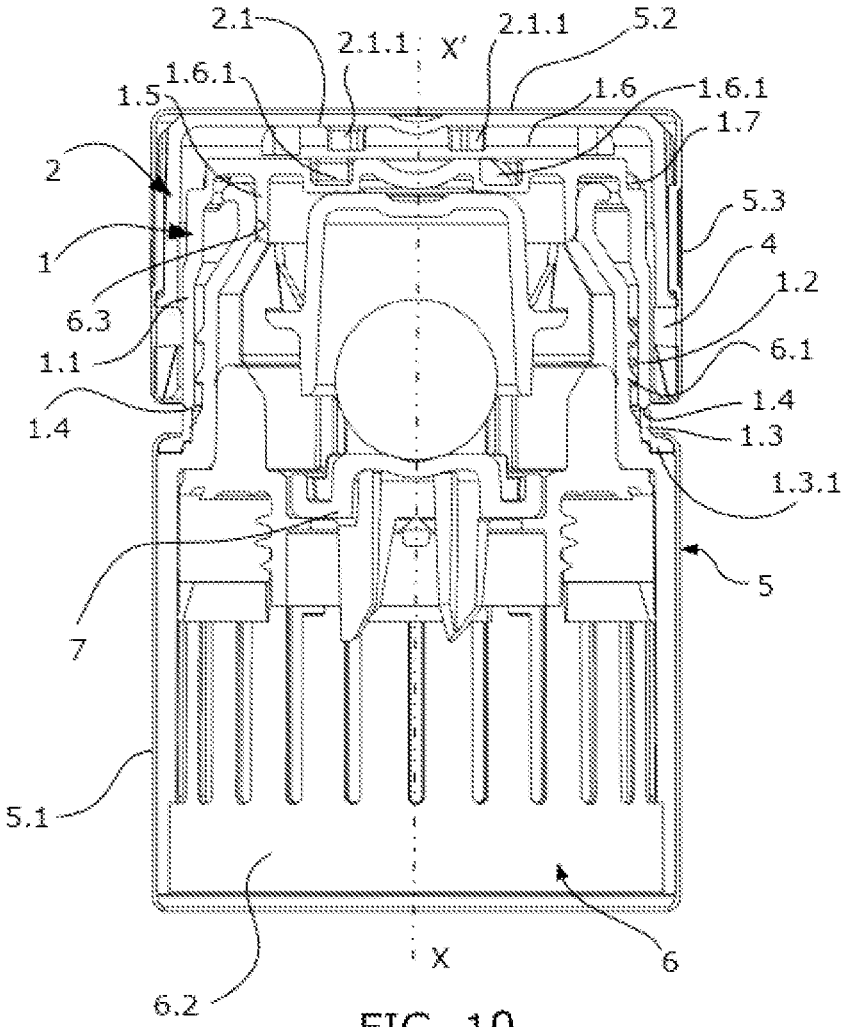
FIG. 10 shows a section view of the closure of FIG. 1B.

FIGS. 1A-1B show an elevational view of the closure where the comparison between a first position of the closure in which a first opening has not taken place, and a second position of the closure showing evidence that a first opening thereof has taken place can particularly be seen. As can be observed in FIGS. 9 and 10 showing a section of the closure of FIGS. 1A-1B, the closure comprises an inner cap (1) and an outer cap (2) as the main components.

The inner cap (1) is formed by a main body (1.1), an inner thread (1.2) which is complementary to the mouth of the container or to a pouring element (6); and fixing means (1.3) which fix the inner cap (1) to the container. Furthermore, the inner cap (1) comprises breakable means (1.4) connecting the main body (1.1) of the inner cap (1) and the fixing means (1.3). Particularly, the breakable means (1.4) break when a pre-established torque between the main body (1.1) and the fixing means (1.3) is surpassed in the operating mode. The outer cap (2) partially houses the main body (1.1) of the inner cap (1).

The closure further comprises a capsule (5) formed by a lower skirt (5.1) and an upper portion (5.2) covering the outer cap (2).

The breakable means (1.4) of the inner cap (1) are configured by means of an assembly of breakable bridges and comprise a lower ring with a perimetral flange (1.3.1) that is retained by means of the lower skirt (5.1) which is notched to thus keep the ring of the fixing means (1.3) fixed to a pouring element (6) or container.

Figure 6:
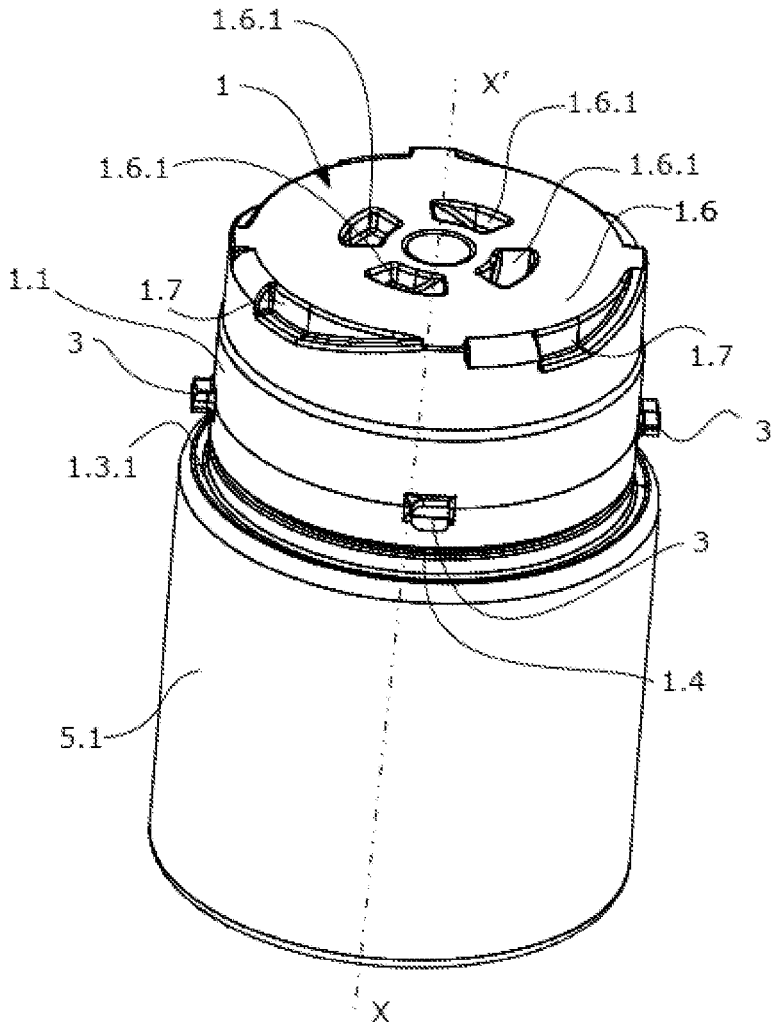
FIG. 6 shows a perspective view of the closure without the outer cap according to an embodiment of the present invention.

In the particular example illustrated in the figures, the inner cap (1) corresponds to a first part of the closure, and the outer cap (2) corresponds to a second part. That is, the inner cap (1) (as shown in FIG. 6) comprises a plurality of flanges (3) protruding from the inner cap (1) outwardly therefrom. Moreover, the outer cap (2) comprises a plurality of grooves (4), in particular, as many grooves (4) as there are flanges (3) comprised in the inner cap (1).

Figure 2:
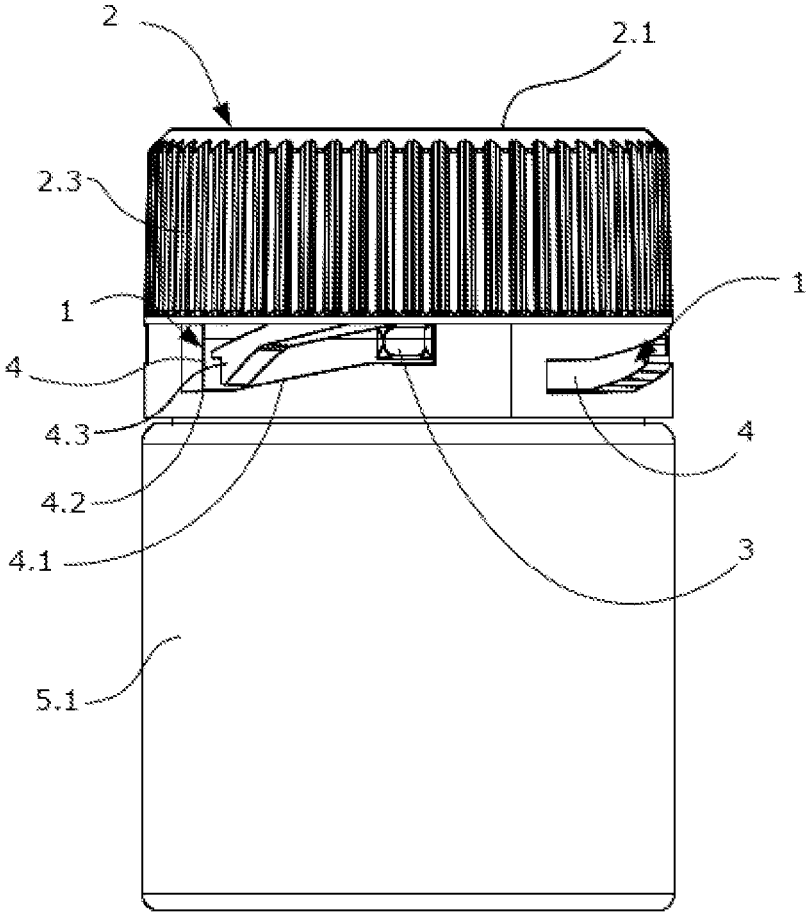
FIG. 2 shows an elevational view of the closure of FIG. 1A without the upper capsule portion.
Figure 3:
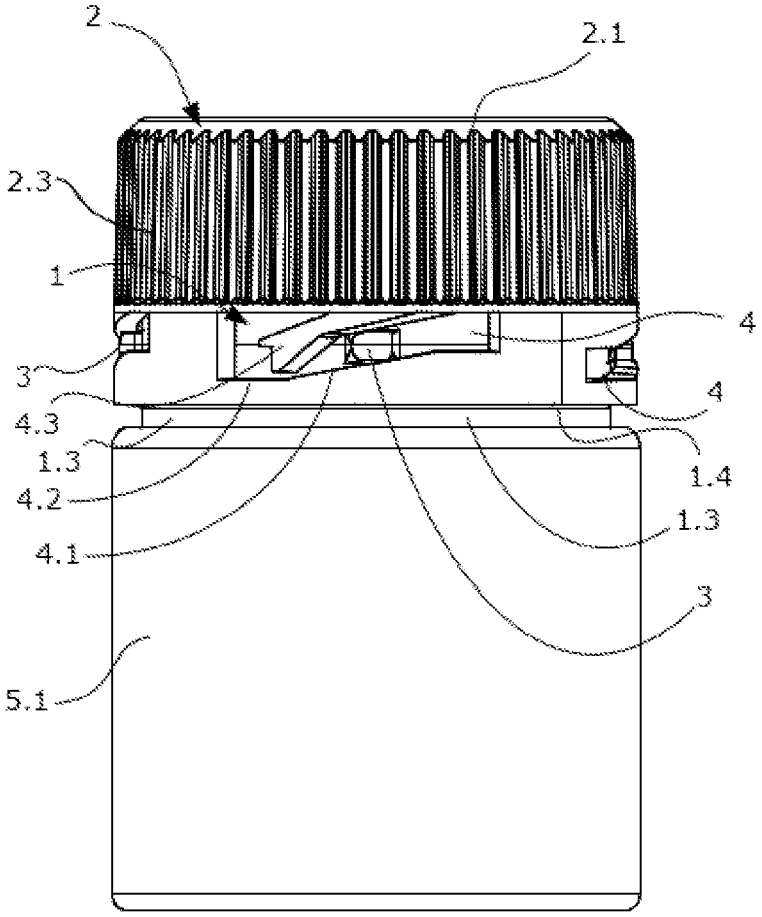
FIG. 3 shows an elevational view of the closure of FIG. 1A without the upper capsule portion in an intermediate position.
Figure 4:
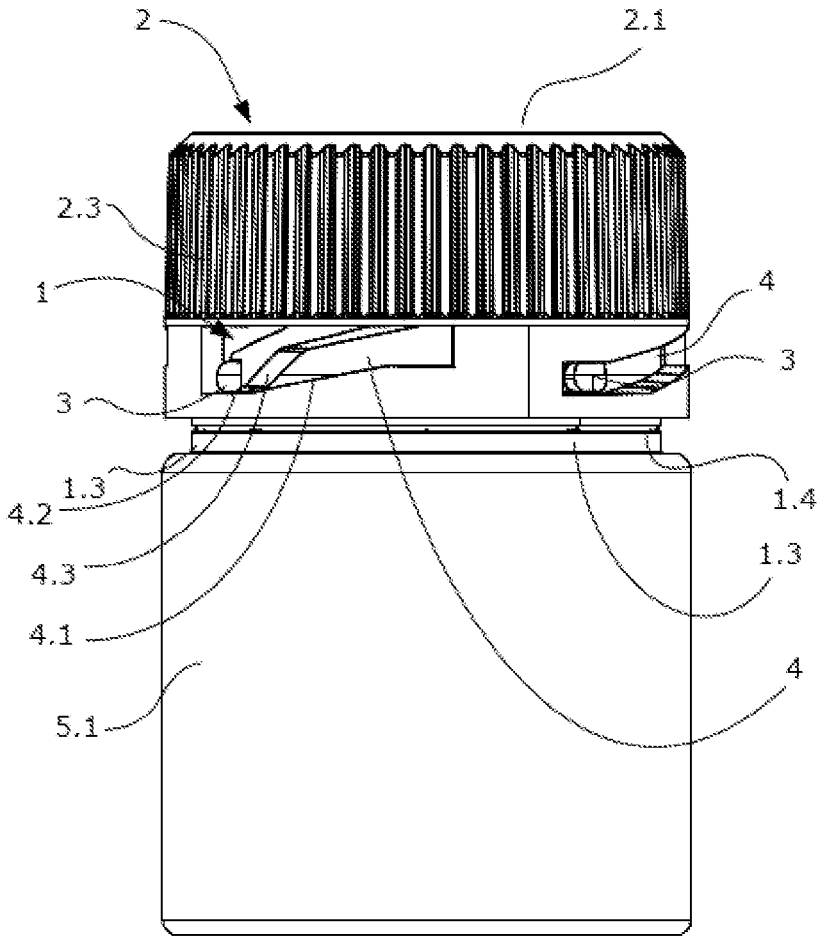
FIG. 4 shows an elevational view of the closure of FIG. 1B without the upper capsule portion.

In particular, FIGS. 2-4 show how the grooves (4) have a helical segment (4.1) according to the axial direction X-X', and this groove (4) is configured for guiding the path of the flange (3) of the inner cap (1). Therefore, a relative rotation between the inner cap (1) and the outer cap (2) brings about a mutual axial movement X-X'. Furthermore, there is shown a housing (4.2) located at one end of the helical segment (4.1) which is intended for receiving the flange (3) moving in its corresponding groove (4). Each groove (4) further has an elastically deformable prolongation (4.3) configured for restricting the section of the groove (4) in at least one part of the helical segment (4.1). In particular, the groove (4) has a section smaller than what is required for the passage of the flange (3). In the operating mode, the forced passage of the flange (3) through the groove (4) thereby causes the bending of the elastically deformable prolongation (4.3). This combination of grooves (4) with flanges (3) is characterized in that the configuration of the groove (4) is such that, after the flange (3) reaches the housing (4.2), the flexible prolongation (4.3) elastically recovers its initial position, irreversibly blocking the flange (3) from coming out of the housing (4.2).

FIGS. 2 to 4 show a movement sequence between the inner cap (1) and the outer cap (2) during the initial phase in a first opening of the closure.

FIG. 2 shows a first position of the closure in which the flanges (3) are housed in the groove (4) at an end opposite where the housing (4.2) is located, while the elastically deformable prolongations (4.3) are in a rest state, i.e., not subject to any bending stress. This is the position and configuration of the cap when, after the manufacture thereof, it is installed on the bottle before the first opening.

FIG. 3 shows an intermediate position of the closure as the first opening thereof is being performed, in which figure it can be observed how the flange (3) has moved in the groove (4) towards the housing (4.2), forcing the bending of the prolongation (4.3) so that said prolongation will allow its passage through the helical segment (4.1) of the groove (4). In this figure, the prolongation (4.3) is slightly bent, upwardly in this case, while at the same time the flange (3) presses on it so as to allow movement through the helical segment (4.1) of the groove (4). FIG. 3 shows a movement for the transition of the closure between the first position and the second position.

FIG. 4 shows a second position of the closure in which the flanges (3) have reached the housing (4.2) after having travelled along the helical segment (4.1) of the groove. In this figure, the prolongation (4.3) has elastically recovered its initial position and is irreversibly blocking the flange (3) from coming out of the housing (4.2).

Therefore, the first position (FIG. 2) describes a position of the closure before the first opening in which the flange (3) is located in the groove (4) in a position away from the housing (4.2). The second position (4) describes a position of the closure after the first opening in which the flange (3) is located in the housing (4.2) after surpassing the segment of the groove (4) restricted by the elastically deformable prolongation (4.3). When the transition from a first position to the second position takes place, the outer cap (2) and the inner cap (1) are axially spaced with respect to the first position, resulting in an irreversible separation between the outer cap (2) and the inner cap (1).

This spacing shows evidence of the first opening of the closure and is visually accessible. In particular, the spacing between the inner cap (1) and the outer cap (2) showing evidence of the first opening of the closure can be observed in FIGS. 1B, 4, and 10. In particular, the spacing between the outer cap (2) and the inner cap (1) after the first opening leaves the ring of the breakable means (1.4) visually accessible.

The torque required for the forced passage of the flange (3) through the groove (4) causing the elastically deformable prolongation (4.3) to bend is less than the torque required to break the breakable means (1.4). The breakable means therefore present sufficient resistance for the inner cap (1) to remain attached to the fixing means (1.3) and ensure the retention for the bending of the elastically deformable prolongation (4.3) to take place.

At this point, the user continues applying torque which now surpasses the resistance of the breakable means (1.4) given that the flanges (3) are supported on the walls of the housing (4.2), completing the opening of the cap and allowing the assembly formed by at least the inner cap (1) and the outer cap (2) to be separated from the container. At this point, with this spaced position, the assembly of the inner cap (1) and outer cap (2) is locked together and acts like a single body.

As observed in FIG. 4, the elastically deformable prolongation (4.3) comprises a configuration which is complementary to at least one part of the flange (3) on which the flange (3) is supported when it is located in the housing (4.1). A support for the flange (3) retaining the bending of the elastically deformable prolongation (4.3) is thereby established. In particular, the prolongation (4.3) comprises at its free end on which the flange (3) is supported in the second position an L-shaped configuration partially surrounding the flange (3) when the latter is located in the housing (4.2) of the groove (4). Furthermore, this support with complementary shapes stabilizes the compression conditions of the elastically deformable prolongation, minimizing the possibilities of buckling in the event of a forced attempt to recover the first position.

In FIGS. 1A-1B, the assembly formed by the grooves (4) and the flanges (3) is concealed under the upper portion (5.2) of the capsule (5).

Figure 5:
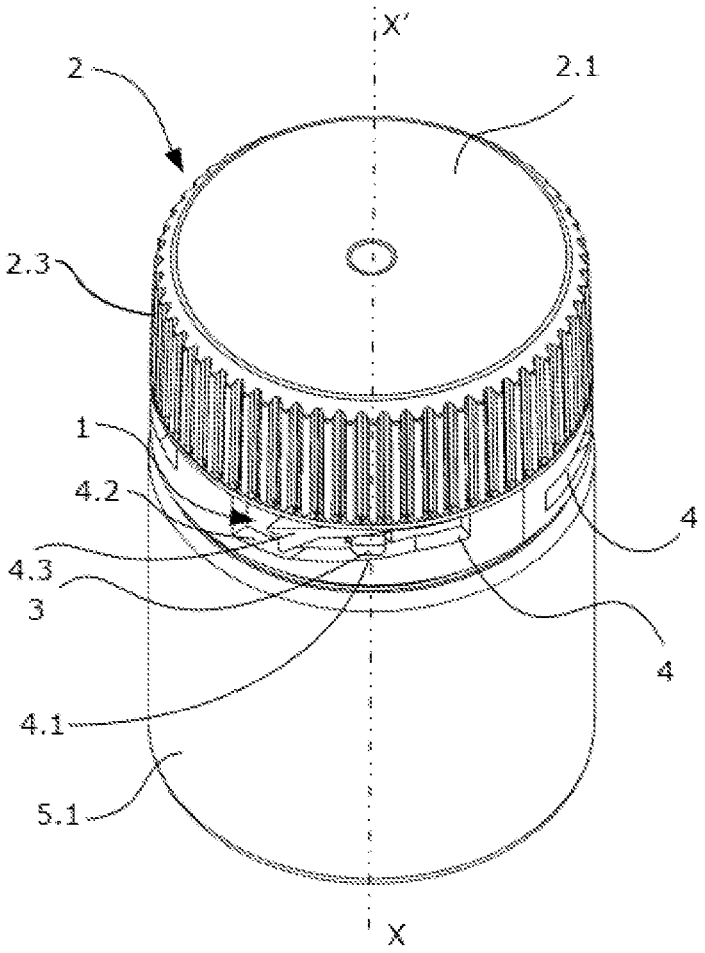
FIG. 5 shows a perspective view of the closure of FIG. 3.

FIG. 5 shows a perspective view of the closure in an intermediate position during the first opening of the closure, as described in detail above for FIG. 3. It is observed in detail in this figure how the outer cap (2) comprises a completely smooth second upper surface (2.1) transverse to the axial axis X-X'.

FIGS. 7 to 10 show a pouring element (6) comprising an outer thread (6.1) which is complementary to the inner thread (1.2) of the inner cap (1), allowing the inner cap (1) to be screwed onto the pouring element (6); and a skirt (6.2) suitable for being coupled to a container. The pouring element (6) further comprises a pouring surface (6.3) on which a prolongation (1.5) of the inner cap (1) is supported, as observed in detail in FIGS. 9 and 10, in order to thus establish a leak-tight closure between the pouring surface (6.3) and the prolongation (1.5) of the inner cap (1).

Furthermore, FIGS. 9 and 10 show a valve (7) for preventing the fraudulent refilling of the container on which the present closure is arranged. This valve (7) remains closed when the container is in the vertical position with the pouring element (6) oriented upwards to prevent the fraudulent refilling.

FIG. 6 shows the closure without the outer cap (2), i.e., only the inner cap (1) is shown. This inner cap (1) comprises a first upper surface (1.6) transverse to the axial axis X-X' with four upper housings (1.6.1) radially spaced from the center established by the axial axis of rotation X-X'. The upper housings (1.6.1) of the inner cap (1) have a variable height which decreases from the upper surface (1.6) of the inner cap (1) to the deepest point of said upper housing (1.6.1). That is, the base of each upper housing (1.6.1) has a ramp configuration.

Figure 7:
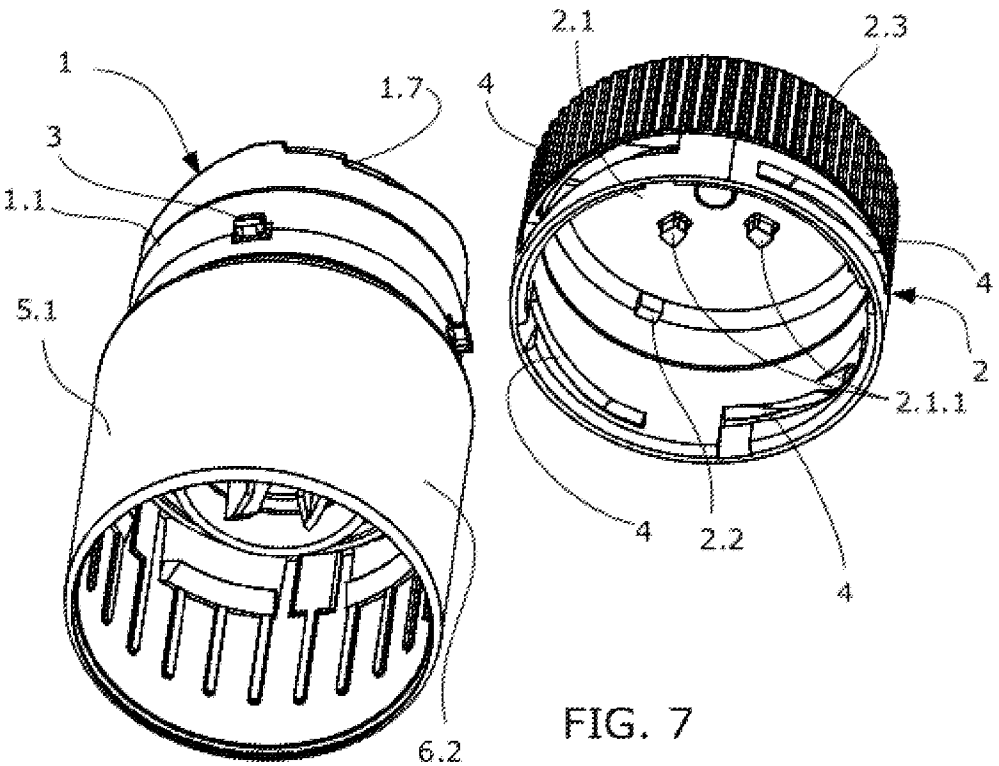
FIG. 7 shows a bottom perspective view of the closure with the outer cap separated according to an embodiment of the present invention.
Figure 8:
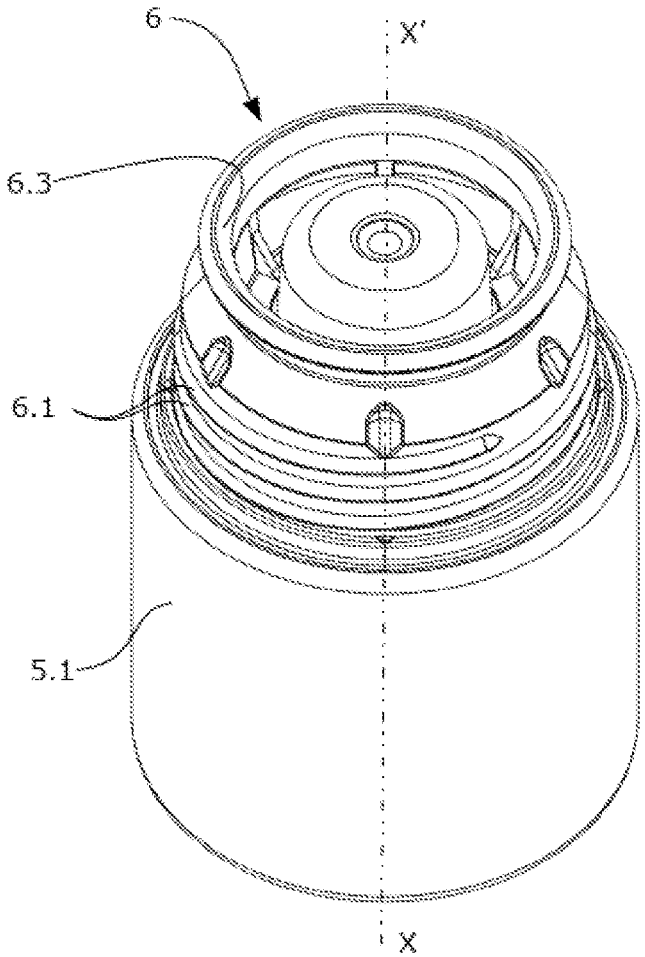
FIG. 8 shows a perspective view of the pouring element without the outer and inner caps according to an embodiment of the present invention.

Moreover, in FIG. 7, the image on the right shows a bottom perspective view of an outer cap (2) of the closure. It can particularly be observed that the outer cap (2) comprises a second upper surface (2.1) transverse to the axial axis X-X' showing two supporting flanges (2.1.1) (of the four that this configuration has) radially spaced from the center established by the axial axis of rotation X-X'. The supporting flanges (2.1.1) are radially spaced by the same distance as the upper housings (1.6.1) of the first upper surface (1.6) of the inner cap. That is, the configuration of the supporting flange (2.1.1) of the inner cap is complementary to the upper housings (1.6.1) of the inner cap. This complementary configuration causes, in the first position between the outer cap (2) and the inner cap (1), the supporting flanges (2.1.1) to be housed in the upper housings (1.6.1), while in the second position the supporting flanges (2.1.1) are in contact with the transverse first upper surface (1.6) and outside of the upper housing (1.6.1). In other words, transitioning from the first position to the second position causes each supporting flange (2.1.1) to move, for example by sliding, along the respective upper housing (1.6.1) until being positioned on the upper surface (1.6) of the inner cap (1). The arrangement of these supporting flanges (2.1.1) supported on the upper surface (1.6) ensures and maintains the blocking of the spacing between the outer cap (2) and the inner cap (1) with respect to an axial stress seeking to force the rest of the assembly.

FIGS. 2 to 5 show how the outer cap (2) comprises a plurality of grooves (2.3) facilitating the gripping thereof. Moreover, the upper portion (5.2) of the capsule (5) is arranged on the outer cap (1) and comprises a toothed configuration (5.3) in only one part of this upper portion (5.2), as can be observed in FIGS. 1A-1B. This portion having a toothed configuration (5.3) of the capsule (5) has been obtained in this embodiment by notching the capsule by plastic deformation on the grooves (2.3) of the outer cap (2). The upper portion (5.2) of the capsule (5) does not rotate according to the outer cap (2) since the toothed configuration (5.3) offers the grooves (2.3) of the outer cap (2) restraint against rotation. Furthermore, the toothed configuration (5.3) of the capsule (5) facilitates the gripping of the closure for the user.

It is observed in FIG. 6 how the inner cap (1) further comprises four perimetral housings (1.7) in the form of a groove with a ramp configuration in at least part of its movement. These perimetral housings (1.7) are complementary to the supports (2.2) arranged on the inside of the outer cap (2), as observed in the image on the right in FIG. 7.

The invention claimed is:

1. A closure for containers with evidence of first opening configured so as to be coupled to the mouth of a container according to an axial direction X-X', comprising:

an inner cap comprising:

a main body;

an inner thread complementary to a thread of either the mouth of the container or of a pouring element;

fixing means adapted for being fixed to the container;

breakable means adapted for connecting the main body and the fixing means, wherein these breakable means are adapted for breaking when a pre-established torque between the main body and the fixing means is surpassed in the operating mode;

an outer cap configured for at least partially housing the main body of the inner cap;

wherein a first part, either the inner cap or the outer cap, comprises a flange directed towards a second part other than the first part, either the outer cap or the inner cap;

wherein the second part comprises:

at least one groove with a helical segment according to the axial direction X-X' configured for guiding the path of the flange of the first part such that a relative rotation between the first part and the second part brings about a mutual axial movement X-X';

a housing for the flange, the housing preferably located at one end of the helical segment;

an elastically deformable prolongation configured for restricting the section of the groove in at least one part of the helical segment, with a section smaller than what is required for the passage of the flange such that, in the operating mode, the forced passage of the flange causes the elastically deformable prolongation to bend;

and wherein the configuration of the groove is such that, after the flange reaches the housing, the flexible prolongation elastically recovers its initial position, partially or completely, irreversibly blocking the flange from coming out of the housing;

wherein the torque required for the forced passage of the flange through the groove causing the elastically deformable prolongation to bend is less than the torque required for breaking the breakable means; and the first part and the second part comprise two end positions:

a first position before the first opening in which the flange is located in the groove in a position away from the housing, and a second position after the first opening in which the flange is located in the housing after surpassing the segment of the groove restricted by the elastically deformable prolongation such that the first part and the second part are axially spaced with respect to the first position resulting in the irreversible separation between the first part and the second part, showing evidence of the first opening, and wherein said spacing is visually accessible.

2. The closure according to claim 1, wherein the first part is the inner cap and the second part is the outer cap.

3. The closure according to claim 2, wherein the elastically deformable prolongation comprises a configuration complementary to at least one part of the flange adapted for being supported on the flange when it is located in the housing and such that it establishes a support retaining the bending of the elastically deformable prolongation.

4. The closure according to any of the preceding claims, wherein the assembly formed by the groove and the flange is concealed.

5. The closure according to claim 1, wherein it further comprises a capsule comprising a lower skirt and an upper portion for covering the outer cap at least partially, wherein:

the breakable means are configured by means of a ring with a perimetral flange;

the lower skirt is notched in order to retain the perimetral flange of the breakable means in order to fix the breakable means either to a pouring element or to the container.

6. The closure according to claim 5, wherein the spacing between the first part and the second part after the first opening leaves the ring of the breakable means visually accessible.

7. The closure according to claim 1, comprising a pouring element configured for being coupled to the container comprising:

an outer thread complementary to the inner thread of the inner cap;

a skirt adapted for being coupled to the container.

8. The closure according to claim 7, wherein the pouring element comprises a pouring surface and the inner cap comprises a complementary prolongation adapted for being supported on the pouring surface in order to establish the leak-tight closure between the two.

9. The closure according to claim 7 or 8, comprising a valve to prevent the fraudulent refilling of the container.

10. The closure according to claim 1, wherein the inner cap comprises a first upper surface transverse to the axial axis X-X' showing at least one upper housing radially spaced from the center established by the axial axis of rotation X-X';

the outer cap comprises a second upper surface transverse to the axial axis X-X' showing at least one supporting flange radially spaced from the center established by the axial axis of rotation X-X' by the same distance as the upper housing of the first upper surface;

wherein:

in the first position between the first part and the second part the supporting flange is housed in the upper housing, and in the second position between the first part and the second part the supporting flange is in contact with the transverse first upper surface and outside of the upper housing.

11. The closure according to claim 10, wherein the at least one upper housing of the inner cap comprises a depth which decreases from the upper surface of the inner cap to the deepest point of said upper housing, such that when transitioning from a first position to a second position, the at least one supporting flange of the outer cap moves along the upper housing from the deepest point of the upper housing until reaching the upper surface and being outside of the upper housing.

12. The closure according to claim 1, wherein the assembly formed by the groove and the flange is concealed by a capsule covering the outer cap.

* * * * *